United States Patent [19]

Shamir

[11] Patent Number: 4,900,019

[45] Date of Patent: Feb. 13, 1990

[54] ARM WRESTLING APPARATUS

[76] Inventor: Yechiel Shamir, Harav Amiel 6, Tel Avid 62 263, Israel

[21] Appl. No.: 290,576

[22] Filed: Dec. 27, 1988

[51] Int. Cl.[4] ..... A63B 21/02

[52] U.S. Cl. ..... 272/138; 272/901

[58] Field of Search ..... 272/67, 135–143, 272/901

[56] References Cited

U.S. PATENT DOCUMENTS

| | | | |
|---|---|---|---|
| 743,204 | 11/1903 | Terry | 272/142 |
| 3,059,476 | 10/1962 | Spradlin | 272/901 X |
| 3,451,675 | 6/1969 | Burzenski | 272/137 |
| 3,947,025 | 3/1976 | Hobby, Jr. | 272/901 X |
| 4,157,179 | 6/1976 | Ecklor, Jr. | 272/136 X |
| 4,184,675 | 1/1980 | Rogerson | 272/901 X |
| 4,343,465 | 8/1982 | Allen | 272/67 |
| 4,754,964 | 7/1988 | Micheals | 272/901 X |
| 4,805,900 | 2/1989 | Sapp | 272/901 X |

*Primary Examiner*—Richard J. Apley

*Assistant Examiner*—Robert W. Bahr

*Attorney, Agent, or Firm*—Charles E. Baxley

[57] ABSTRACT

An apparatus is disclosed for practicing arm wrestling. A handle is provided for a wrestler's primary wrestling hand. The handle is mounted on a base plate which accommodates adjusting its length to suit the wrestler. A spring resists displacement of the handle by the wrestler. The spring may be a plurality of tension springs or it may comprise a helical spring mounted about the handle. Push bars, a near one on the wrestler's side of the handle and a far one on the side of the handle remote from the wrestler, and both adjustably connectable to the base plate, allow adjustment of the apparatus to accommodate various sizes and shapes of wrestlers. A saddle is adjustably positionable on the base plate for receiving the wrestler's elbow of his primary wrestling arm. The near push bar is provided with a grip for grasping by the wrestler's secondary hand, and a pad is provided on the near push bar to protect the wrestler's primary wrestling hand coming down.

2 Claims, 2 Drawing Sheets

ARM WRESTLING APPARATUS

This invention relates to an exercising apparatus, more particularly to a self-operated device for practicing arm wrestling.

PRIOR ART

Arm wrestling has become a favorite game or sport engaging many contestants world-wide. Winning the wrestle depends largely in skill, practice and specific arm muscle development. The rule of the game demands that the contestants place their arms in the wrestling positions by resting their appropriate elbows on a supporting surface, and the forearms and upper arms are located in substantially a common vertical position. The contestant's hands are clasped, and each contestant seeks to press his opponent's wrist or hand downward against the surface by rotating his forearm and that of his contestant about their respective elbows as centers. The contestant's elbows must not be moved in any direction during the wrestling procedure.

To enable wrestlers to practice on their own wrestling techniques at different strength levels, several practicing devices have been known in the prior art; U.S. Pat. No. 3019019 filed in January, 1961, describes a structure comprising a bracket for attachment to a table edge, having a U shaped yoke secured to the base, and an inclined strip secured at right angles to the yoke, and secured to the base. The strip has a pulley sheave member slidably mounted on it, having an elongated slot with a locking mechanism adjustable for different desired elevations of the sheave carrying weights at its lower end, the top of the chain is provided with a handle adapted to be grasped by the user's hand and pulled forward for raising the weights.

U.S. Pat. No. 3,633,907 filed in July 1970 describes an arm wrestling apparatus comprising of a swing arm connected to a base, allowing the swing arm to pivot about its connection when being pulled. One or more tension strips are connected to the base on one end, and on the other end extending through the openings in the free end of the swing arm, then connected to a handle. When practicing, the user grasps the handle and pulls the handle towards him thus stretching the tension strips.

U.S. Pat. No. 3,815,904 filed in December 1972, describes an exercising apparatus comprising two handle grips connected by a variable number of elastic closed bands engaged to each of the grips, the number of desired bands can be chosen by a person exercising, and changed accordingly. One of the grips is securely connected to a flat, rigid board, clamped to a flat supporting surface, having some sort of a cushion means (such as a pad) positioned on the flat surface at a distance convenient for the user grasping with his palm the second grip, and placing his elbow on the cushion, that the user can exercise arm wrestling by pulling the grip handle down thus stretching the elastic bands.

U.S. Pat. No. 3,953,026 filed in April 1976 describes an apparatus for practicing arm wrestling comprising an elongated rectanglular frame, a shaft pivotally supported within the frame, an arm affixed to one end of the shaft and extending generally perpendicularly thereto, a sheave mounted on the shaft and rotated by rotation of the arm, a cable attached at one end to the periphery of the sheave, a spring secured to the frame and to the other end of the cable, a hand bar attached at the outer end of the arm and extending generally perpendicularly thereto such that as the arm is rotated about the shaft the sheave is rotated, winding the cable thereon and stretching the spring to impact a restraint on the rotation of the arm.

All of the devices descibed in the prior art have the following defaults:

(a) The apparatus has no means to adjust the height of the handle to be grasped by the user.
(b) The apparatus is not easily adjustable to be handled by either left or right arm.
(c) The angle of pull of the arm does not resemble the precise angle applied in the actual arm wrestling game.
(d) The power variability in most devices is not comfortably adjustable.
(e) There are no means provided to support the second non-participating arm.

SUMMARY OF THE INVENTION

It is the object of this invention to provide an arm wrestling exercising apparatus which will overcome most or all of the defaults of the prior art; and could be manufactured cheaply, dismountable, and packaged in a neat form.

The arm wrestling apparatus hereby provided comprises of a handle bar having means to adjust its length, connected at its one end by a helical spring to a supporting base plate; and said handle bar has a spring like means resulting forced resistance to bending of said handle bar to any desired direction; and said base plate has means to be secured by a screw clamp to a desired table; and two dismountable push bars are connected having adjustable length means to said base plate on both sides of said handle; and on said push bar mounted on the nearer side to the user of the apparatus, there is provided a far side handle to support the users free arm; and a cushion pad is mounted on the central part of said nearer bar to protect the wrestled arm when coming down; and a second cushion pad is mounted on said base plate to provide protection to the user's elbow at an adjustable distance from said handle; and the far side push bar mounted at the back of said handle has means to be secured by a screw clamp to said table.

In one preferred embodiment said spring like means connected to said handle and said far side push bar, comprises a plurality of stretch springs hooked on one side to a plate mounted on the far side of said push bar; and on the other side to a plate connected to the top part of said handle bar through a stretch force slider measuring device; so that the user can adjust the applied force by adding or subtracting the number of springs applied, as well as adjust the starting position of said handle by pulling in or out said far side push bar, before fixing it to said base plate.

The user will be able to measure the relative stretch force applied on each exercise by reading the stretch force slider position, which must be readjusted on each cycle.

In the most preferred embodiment, the spring like means causing forced resistance of the handle is provided by incorporating two exchangeable concentric helical springs connecting by a screw the handle with the base plate; said springs having adjustable stretch force means achieved by turning said handle around its axis thus applying a tightening screw of said inner helical spring hence increasing or decreasing the stretch force as required;

The advantage of this embodiment to many of the other suggested forms is that it is easily adjustable to any required force, and is safer to the user having no external free springs.

In the preferred embodiment the inner spring is of 1–2 cm diameter, of 2–4 mm wire, and the outer spring has a diameter of 4–5 centimeters of 4–6 mm metal wire, the springs length should be in the range of 10–20 centimeters.

DESCRIPTION OF THE PREFERRED EMBODIMENTS

Figure 1:
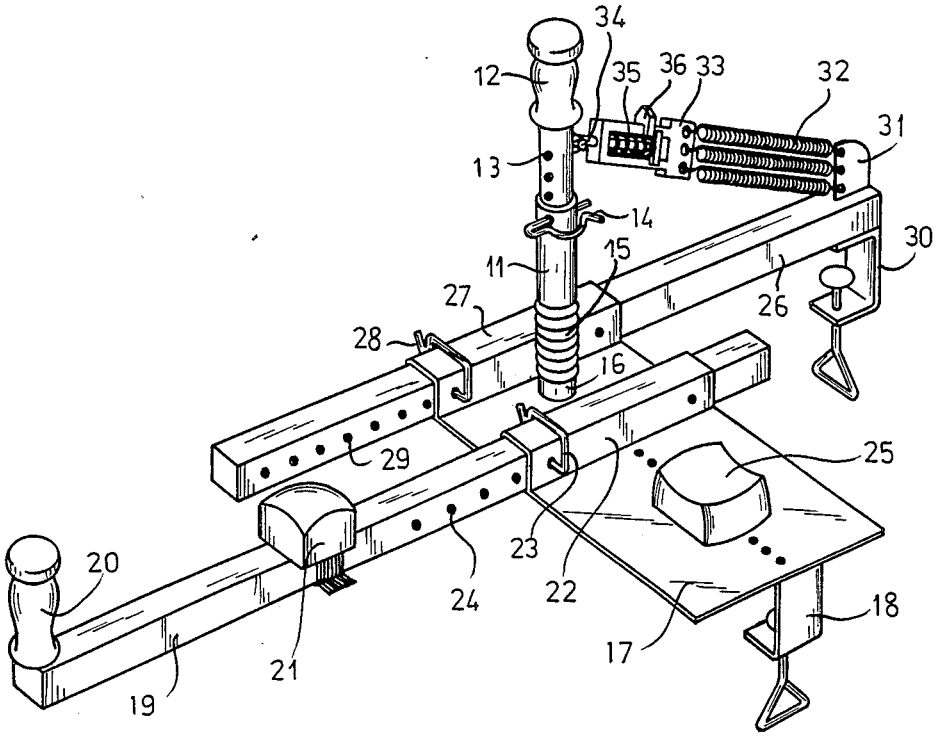
FIG. 1 illustrates an arm wrestling apparatus having external adjustable multiple spring mechanism.

Referring to the drawings which are not to scale. FIG. 1 illustrates an arm wrestling apparatus comprising a handle bar 11 consisting of a handle piece 12, having a slideable holed shaft 13 to be fixed at any required height by a securing pin 14. The handle 11 is secured to a base plate 17 by means of a helical spring 15, connected to the base plate 17 by a connector 16. The base plate 17 is clamped to a table (not seen) by a screw clamp 18. A front push bar 19 is mounted on to the base plate 17 by securing the grooves 24 to the channeled plate 22 by a securing pin connector 23, at any required position convenient for a user wrestler to grasp a handle 20 mounted on the end of the push bar 19. A cushion 21 is mounted at any convenient distance to act as protection for the coming down wrestled arm. A cushion pad 25 acts as protection to the wrestler's elbow is mounted to base plate 17 at a desired distance from the handle 11. A far side push bar 26 is clamped to the table (not seen) by a screw clamp 30. The push bar 26 is secured to the table channeled plate 27 by means of a securing pin connector 28 securing grooves 29 of the bar 26 to the plate 27 at any required position. A plurality of springs 32 are connectable to a plate 31 mounted on the push bar 26, and at their other ends to a plate 33 which is connected to the handle 11 by a connector 34 through a stretch force measuring device 35 having a slider 36 showing its position on both sides. The apparatus is operated by the user by first adjusting the required height of the handle by means of the connector 14, then adjusting the required stretch distance by means of the 28 of push bar 26 which is firmly clampled to the table by screw clamp 30. The force magnitude is determined by the number and strength of the springs 32 suspended between the plates 31 and 33.

The user then adjusts the convenient position of the handle 20 for his free arm hold. He then places his elbow on the cushion pad 25, grasps the handle 12 and presses it toward the cushion pad 21.

If a change of hands is required the two push bars 26 and 19 reverse positions, and the shaft 13 is turned 180° locked again by the securing pin 14 and the springs 32 position changes sides.

Figure 2:
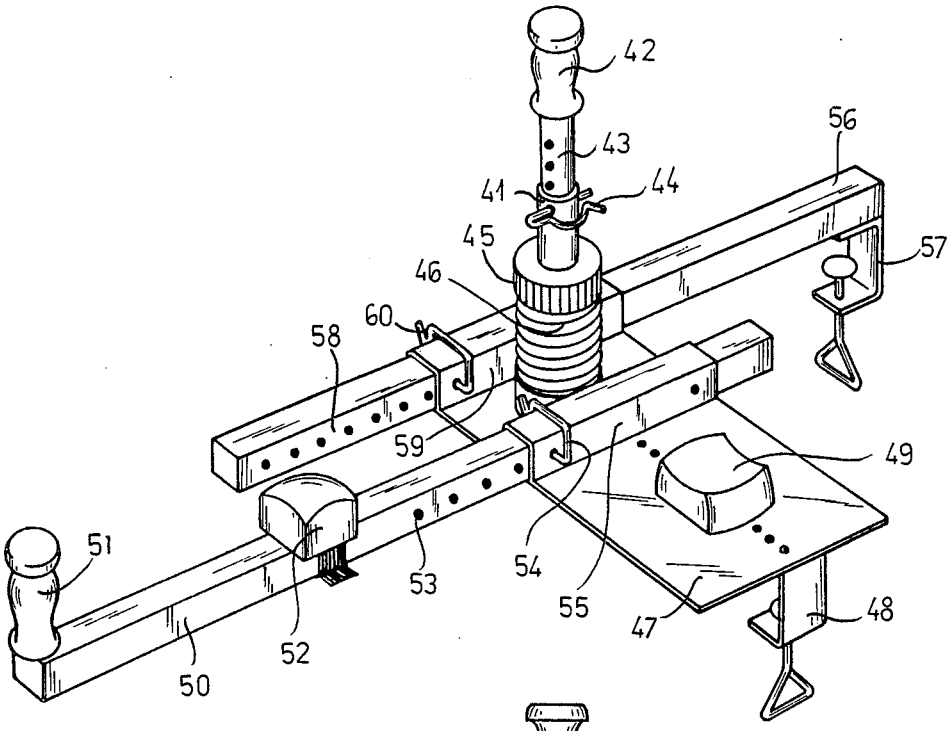
FIG. 2 illustrates an arm wrestling apparatus having two concentric helical springs incorporated with the wrestling handle.
Figure 3:
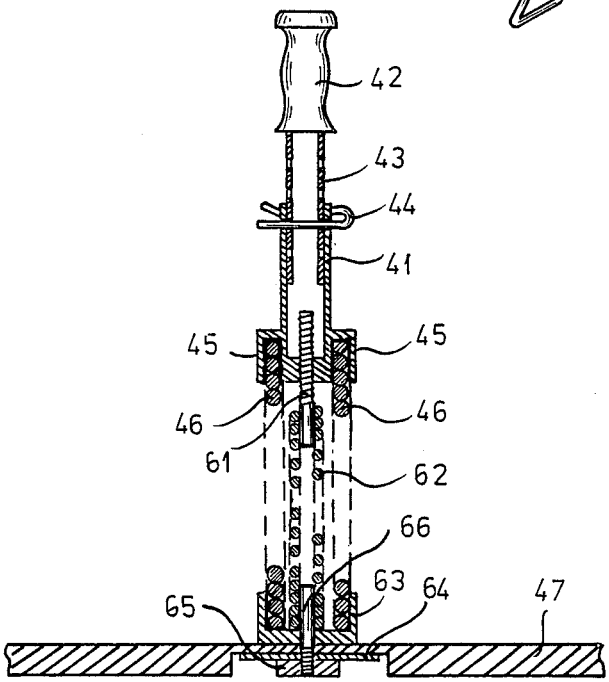
FIG. 3 illustrates the cross section of the handle and concentric helical springs as FIG. 2.

FIG. 2 illustrates a different embodiment of the invention wherein the handle bar 41 has a handle piece 42 having a slideable grooved shaft 43 secured to the handle 41 by the connector 44. The handle bar 41 is connected to the base plate 47 by means of two concentric springs 46. The details of the connection mechanism is shown in FIG. 3 below. The cup 45 being the end piece of handle 41 houses the upper part of a concentric helical spring 46. The base plate 47 is secured to the table by a screw clamp 48. A cushion pad 49 is mounted on the base plate 47 at any required position from the handle bar 41.

A patch bar 50 is mounted to the base plate 47 by securing the grooves 53 to the channeled plate 55 by the securing pin 54. A handle 51 is mounted at the end of the push bar 50, and a cushion pad 52 is mounted at any desired distance to protect the user's arm coming down.

Push bar 56 is mounted at the back and clamped to the table (not seen) by a screw clamp 57. The bar 56 is secured to the base plate 47 by a securing pin 60 connecting a channeled plate 59 with grooves 58 of the push bar 56.

To understand the structure of the two concentric springs, and the mechanism by which they are mounted to the basic plates, a cross section of the handle is shown in FIG. 3.

The handle bar 41 is mounted to the sliding shaft 43 by means of the securing pin 44 securing the handle through holes in the shaft 43. The handle bar bottom cup 45 has a circular groove on its bottom into which the outer coarse helical spring 46 is mounted freely. An inner helical spring 62 is welded or connected to a screw 61 which is screwed into the central part of the cup 45 to a desired position. The coarse spring 46 is placed freely at its other side into a lower cup 63 which is placed on the base plate 47 and secured to it by a screw pin 66 and a nut 65 through a washer 64. The inner helical spring 62 is welded or connected to the screw pin 66.

The apparatus is operated by the user by first adjusting the required stretch force of the handle by turning the handle 42, thus setting the strength of the inner helical spring 62 engaging the screw cap 45 to a desired position, and then adjusting the handle piece 42 at the desired height by the pin connector 44 and the movement of the shafts 43. The user then adjusts the required free arm handle 51 distance by adjusting the position of the push bar 50. The push bar 56 is secured to the table by means of the screw clamp 57. The user then places his elbow on the cushion pad 49, grasps the handle 42 with the wrestling arm and presses it towards the cushion pad 52. When the user wishes to change arms the two push bars 50 and 56 are reversed.

It should be noted that by exchanging both concentric helical springs, using different strength one can adjust the apparatus to fit both children and adult strengths.

The two embodiments were described in detail but it should be appreciated that various changes, substitutions and alterations can be made therein without departing from the general scope of the invention.

I claim:

1. An arm wrestling apparatus comprising:

a handle for a user's primary hand and having means for adjusting its length and connected at one end to a base plate, the handle provided with biasing means for resisting its being displaced, a saddle adjustably positionably on the base plate for receiving an elbow associated with the user's primary hand, a first push bar connected to the base plate adjustably on a user's side of the handle, the first push bar provided with a grip for grasping by the user's secondary hand and a pad to protect the user's primary hand coming down, a screw mounted on the base plate, the handle being screwably engagable into the screw, the biasing means comprising an outer helical spring positioned about the screw in compression between the handle and the base plate, whereby the engagement of the handle relative to the screw presets the force of the spring.

2. The apparatus of claim 1 further comprising an inner helical spring positioned inward of the outer spring and connected fixedly to both the screw and to the base plate.

* * * * *